US008265495B2

(12) United States Patent
Sato

(10) Patent No.: US 8,265,495 B2
(45) Date of Patent: Sep. 11, 2012

(54) HEATING DEVICE AND IMAGE FORMING APPARATUS WITH ABNORMALITY DETECTION

(75) Inventor: Toshiki Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 265 days.

(21) Appl. No.: 12/775,554

(22) Filed: May 7, 2010

(65) Prior Publication Data

US 2010/0290796 A1 Nov. 18, 2010

(30) Foreign Application Priority Data

May 14, 2009 (JP) ..... 2009-118074

(51) Int. Cl.
*G03G 15/20* (2006.01)

(52) U.S. Cl. ..... 399/33

(58) Field of Classification Search ..... 399/33, 399/69, 329

See application file for complete search history.

(56) References Cited

FOREIGN PATENT DOCUMENTS

| | | | | |
|---|---|---|---|---|
| JP | 61156079 | A | * | 7/1986 |
| JP | 09185276 | A | * | 7/1997 |
| JP | 2002139956 | A | * | 5/2002 |
| JP | 2005-242111 | A | | 9/2005 |
| JP | 2008102464 | A | * | 5/2008 |
| JP | 2009300959 | A | * | 12/2009 |

* cited by examiner

*Primary Examiner* — Quana M Grainger
(74) *Attorney, Agent, or Firm* — Marvin A. Motsenbocker; Mots Law, PLLC

(57) ABSTRACT

A heating device includes: a driving member configured to rotate; a driven member configured to rotate with the rotation of the driving member; a heater configured to heat a surface of one of the driving member and the driven member; a temperature detector configured to measure the temperature of the heated surface; and a controller operable to control heating of the heater based on the measurement result of the temperature detector. The controller includes: a calculator operable to calculate a change ratio of a slope of a temperature change of the heated surface with time, based on a first temperature detected by the temperature detector at a first time point and a second temperature detected by the temperature detector at a second time point a predetermined time interval after the first time point; and a determiner operable to determine that an abnormality occurs when the change ratio exceeds a threshold.

19 Claims, 9 Drawing Sheets

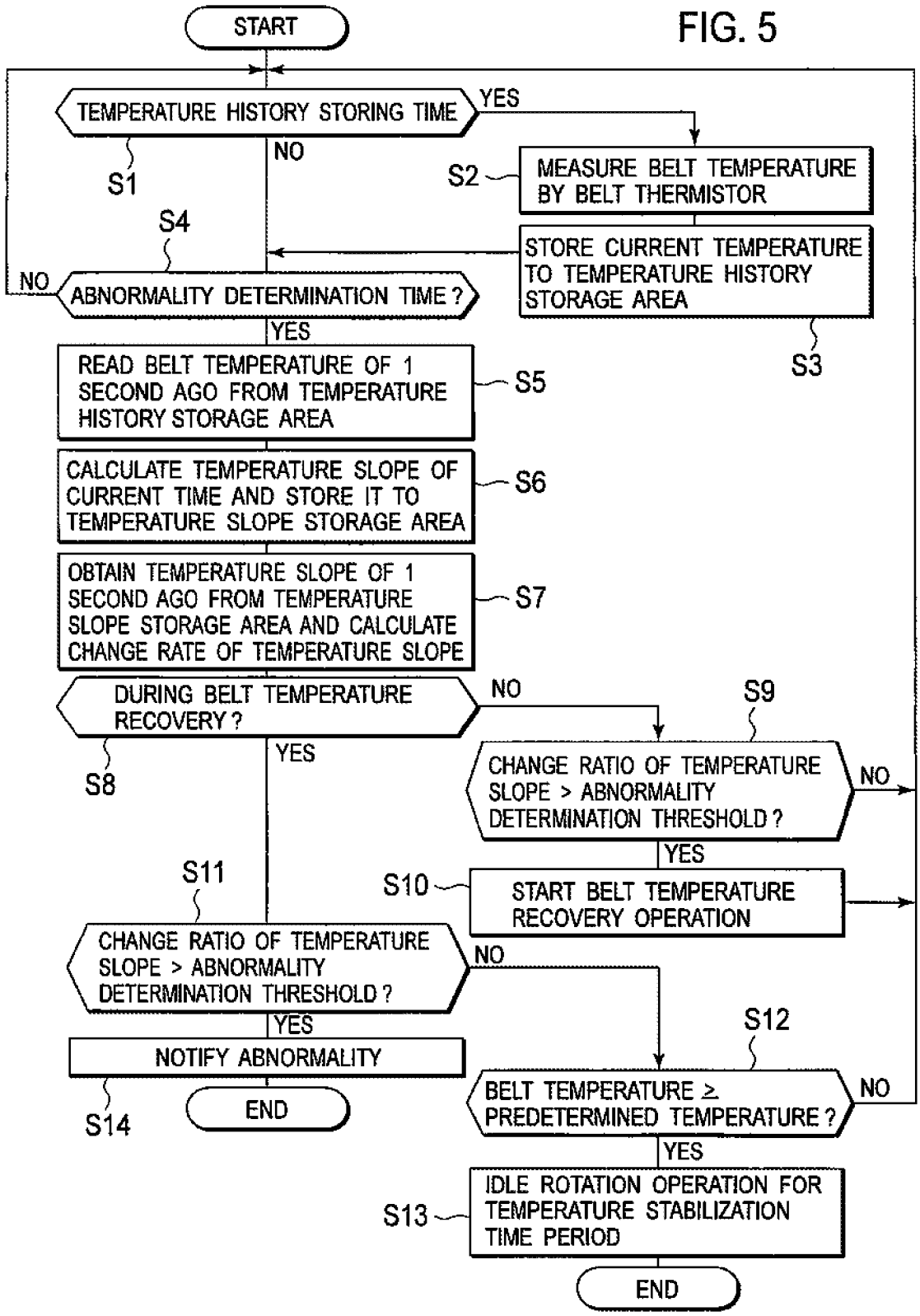
FIG. 5
START
TEMPERATURE HISTORY STORING TIME
YES
NO
S1
S2
MEASURE BELT TEMPERATURE BY BELT THERMISTOR
S4
STORE CURRENT TEMPERATURE TO TEMPERATURE HISTORY STORAGE AREA
NO
ABNORMALITY DETERMINATION TIME ?
YES
S3
READ BELT TEMPERATURE OF 1 SECOND AGO FROM TEMPERATURE HISTORY STORAGE AREA
S5
CALCULATE TEMPERATURE SLOPE OF CURRENT TIME AND STORE IT TO TEMPERATURE SLOPE STORAGE AREA
S6
OBTAIN TEMPERATURE SLOPE OF 1 SECOND AGO FROM TEMPERATURE SLOPE STORAGE AREA AND CALCULATE CHANGE RATE OF TEMPERATURE SLOPE
S7
DURING BELT TEMPERATURE RECOVERY ?
NO
S9
S8
YES
CHANGE RATIO OF TEMPERATURE SLOPE > ABNORMALITY DETERMINATION THRESHOLD ?
NO
YES
S11
S10
START BELT TEMPERATURE RECOVERY OPERATION
CHANGE RATIO OF TEMPERATURE SLOPE > ABNORMALITY DETERMINATION THRESHOLD ?
NO
YES
S12
NOTIFY ABNORMALITY
BELT TEMPERATURE ≥ PREDETERMINED TEMPERATURE ?
NO
S14
END
YES
IDLE ROTATION OPERATION FOR TEMPERATURE STABILIZATION TIME PERIOD
S13
END

HEATING DEVICE AND IMAGE FORMING APPARATUS WITH ABNORMALITY DETECTION

CROSS REFERENCE TO RELATED APPLICATIONS

This application claims priority based on 35 USC 119 from prior Japanese Patent Application No. P2009-118074 filed on May 14, 2009, entitled "Heating Device and Image Forming Apparatus Having The Same", the entire contents of which are incorporated herein by reference.

BACKGROUND OF THE INVENTION

1. Field of the Invention

The invention relates to a heating device, such as a fixing unit including a fixing belt, and to an image forming apparatus having the heating device.

2. Description of Related Art

An electrophotographic printer transfers a toner image corresponding to a print image to a paper sheet and fixes the toner image to the paper sheet by pressure and heat.

A conventional fixing unit includes a heating roller, a fixing roller, a fixing belt (endless belt) extending between and wound around the heating roller and the fixing roller, and a pressure roller that is provided outside the fixing belt and pressed against the fixing roller via the fixing belt and has therein a heater. The heating roller heats the fixing belt, and the heated belt and the pressure roller pressed against the heated belt presses and heats a paper sheet, onto which a toner image has been transferred and which is conveyed through the nip between the heated belt and the pressure roller, thereby fixing the toner image to the paper sheet (for example, Japanese Patent Application Laid-Open No. 2005-242111, Paragraphs 0008 to 0017 and FIG. 2).

SUMMARY OF THE INVENTION

However, in the conventional technique, the heated fixing belt and the pressure roller, which is pressed against the fixing belt, press and heat the toner image on the paper sheet to fix the toner image to the paper sheet. If the pressure roller slips on the fixing belt, the rotation of the fixing belt stops so that the part of fixing belt, which the heating roller temporarily keeps contacting, is excessively heated.

In case of such a slip, the part of the fixing belt that is kept heated by the heating roller rapidly increases in temperature, and this may damage the fixing belt and the fixing unit.

An object of the invention is to readily detect an abnormality such as a slip in the heating device such as the fixing unit to prevent the heating device from being overheated.

A first aspect of the invention is a heating device including: a driving member configured to be driven by a driver and to rotate; a driven member being in contact with the driving member and configured to rotate with the rotation of the driving member; a heater configured to heat a surface of one of the driving member and the driven member; a temperature detector configured to measure the temperature of the heated surface; and a controller operable to control heating of the heater based on the measurement result of the temperature detector. The controller includes: a calculator operable to calculate a change ratio of the slope of a temperature change of the heated surface with time, based on a first temperature detected by the temperature detector at a first time point and a second temperature detected by the temperature detector at a second time point, which is a time point when a predetermined length of time passes from the first time point; and a determiner operable to determine that an abnormality occurs when the change ratio exceeds a threshold.

A second aspect of the invention is a heating device including: a driving member configured to be driven by a driver and to rotate; a driven member being in contact with the driving member and configured to rotate with the rotation of the driving member; a heater configured to heat a surface of one of the driving member and the driven member; a first temperature detector configured to measure the temperature of the heated surface; a second temperature detector configured to measure the temperature around the heater; and a controller operable to control heating of the heater. The controller includes: a first calculator operable to calculate a slope of a first temperature difference of a first time point, the first temperature difference being a difference between a first temperature detected by the first temperature detector at the first time point and a second temperature detected by the second temperature detector at the first time point; a second calculator operable to calculate a slope of a second temperature difference of a second time point which is a time point when a predetermined length of time passes from the first time point, the second temperature difference being a difference between a third temperature detected by the first temperature detector at the second time point and a fourth temperature detected by the second temperature detector at the second time point; a third calculator operable to calculate a change ratio of temperature difference slope, based on the slope of the first temperature difference and the slope of the second temperature difference; and a determiner operable to determine that an abnormality occurs when the change ratio of the temperature difference exceeds a threshold.

A third aspect of the invention is a heating device including: a driving member configured to be driven by a driver and to rotate; a driven member being in contact with the driving member and configured to rotate with the rotation of the driving member; a heater configured to heat a surface of one of the driving member and the driven member; a temperature detector configured to measure the temperature of the heated surface; and a controller operable to control heating of the heater based on the measurement result of the temperature detector. The controller includes: a determiner operable to determine that an abnormality occurs when a second order differential value of change of the temperature detected by the temperature detector with time exceeds a threshold.

A fourth aspect of the invention is an image forming apparatus including the heating device according to the first aspect.

A fifth aspect of the invention is an image forming apparatus comprising the heating device of the second aspect.

A sixth aspect of the invention is an image forming apparatus comprising the heating device of the third aspect.

According to the aspects of the invention, an occurrence of an abnormality of the driven member is easily detected to prevent the driven member from being overheated.

BREIF DESCRIPTION OF THE DRAWINGS

FIG. 5 is a flow chart of an abnormality detection process of the first embodiment.

Figure 6A:
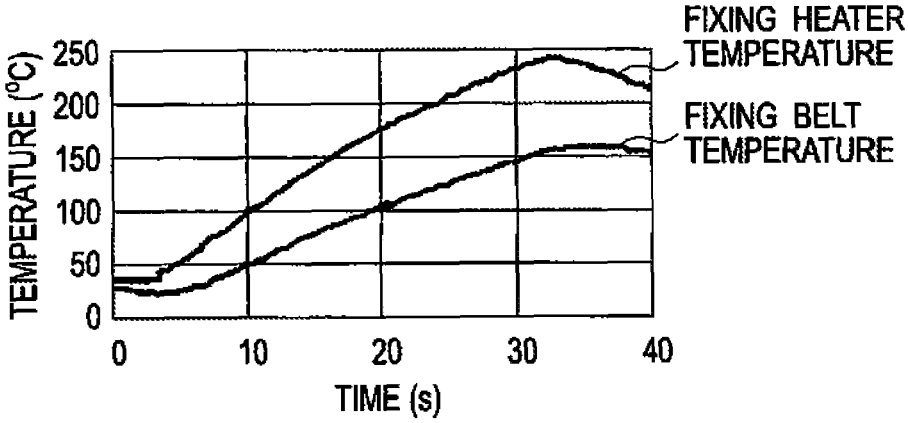
Figure 6B:
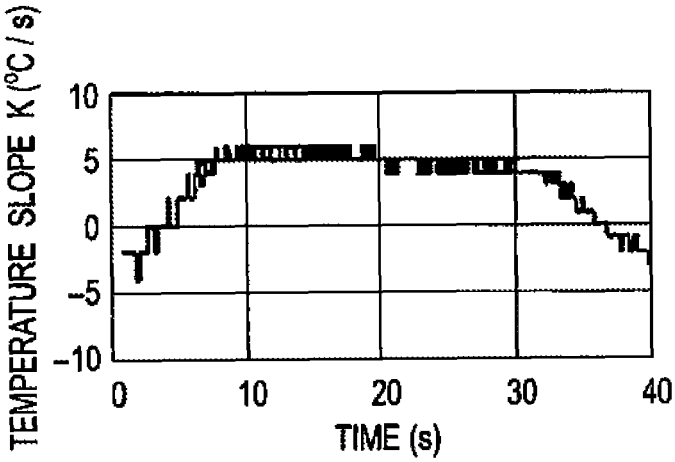
Figure 6C:
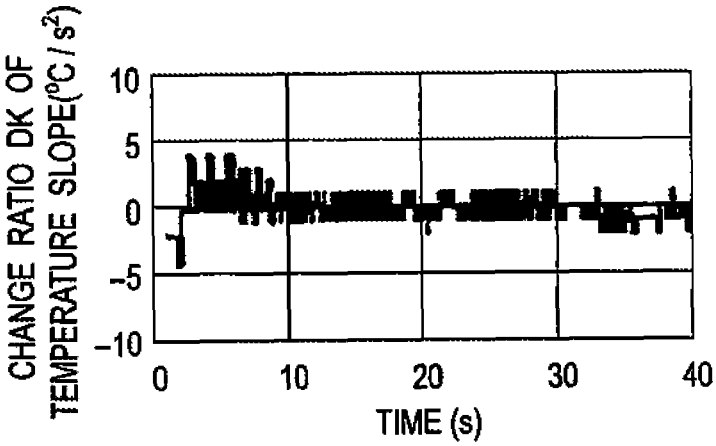

FIGS. 6A, 6B, and 6C show the temperature change of a fixing belt when the fixing unit operates normally according to the first embodiment.

Figure 7A:
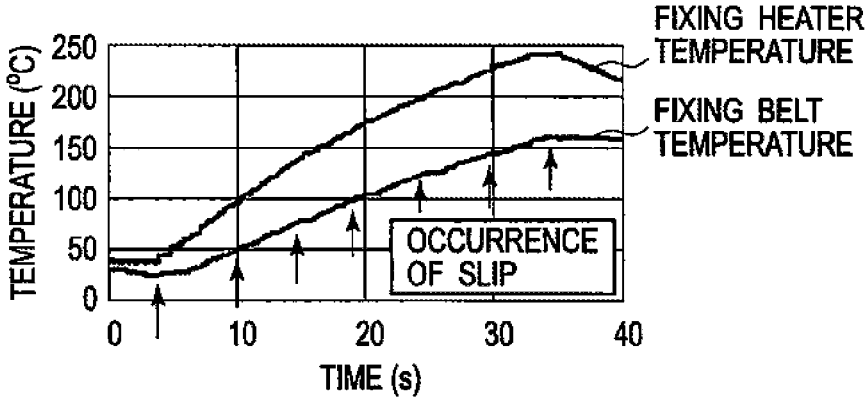
Figure 7B:
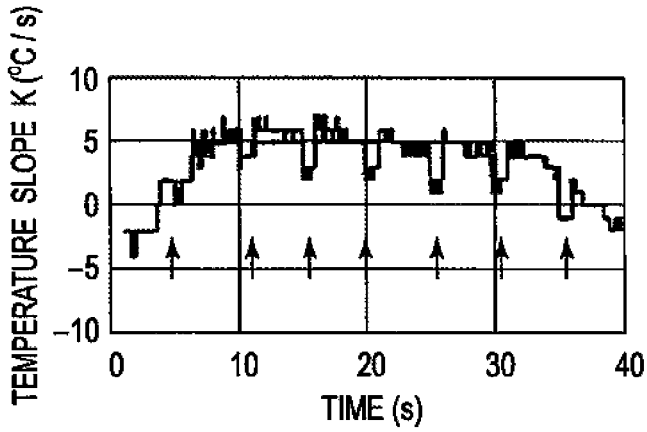
Figure 7C:
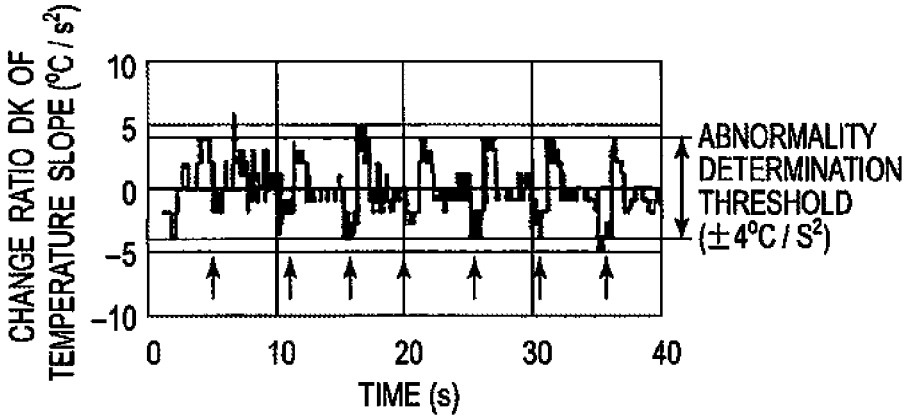

FIGS. 7A, 7B, and 7C show the temperature change of the fixing belt when a slip occurs in the fixing unit according to the first embodiment.

Figure 8A:
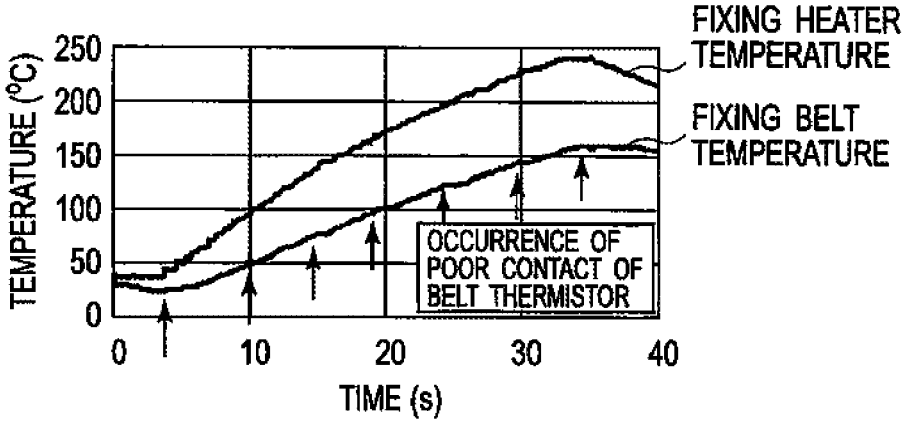
Figure 8B:
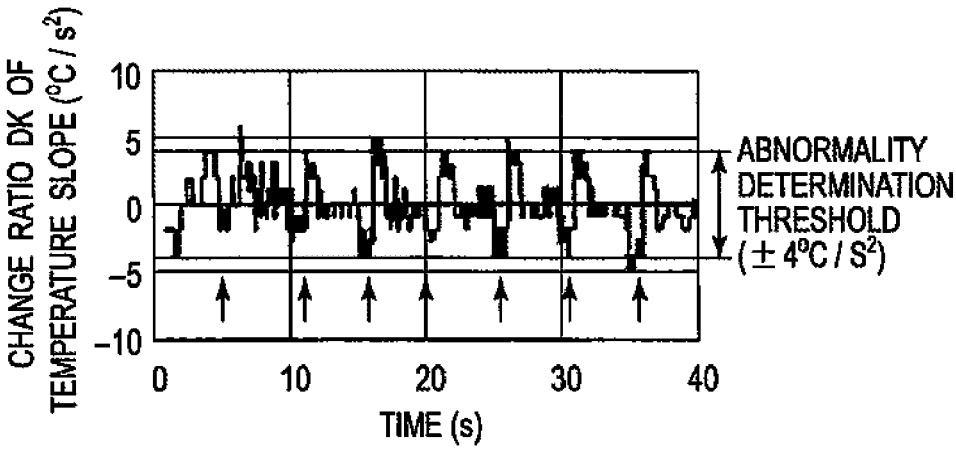

FIGS. 8A and 8B show a change ratio of a temperature slope of the fixing belt when poor contact of the temperature detector occurs in the fixing unit according to the first embodiment.

Figure 9:
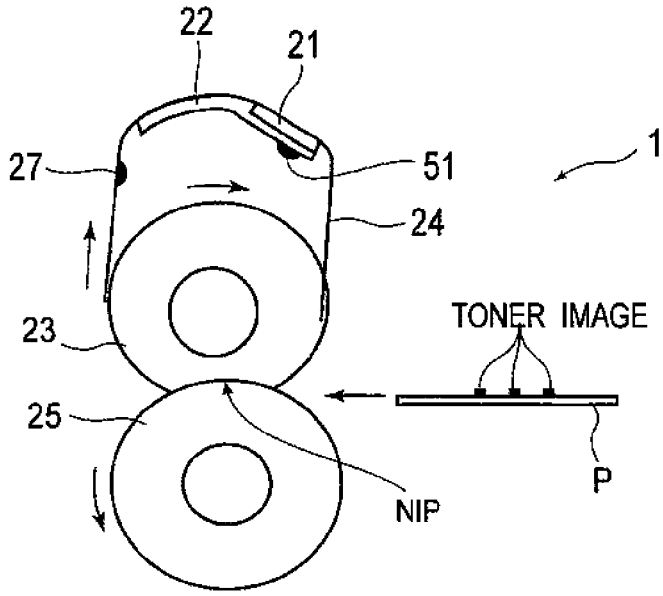

FIG. 9 is a side view of a schematic configuration of a fixing unit of a second embodiment.

Figure 10:
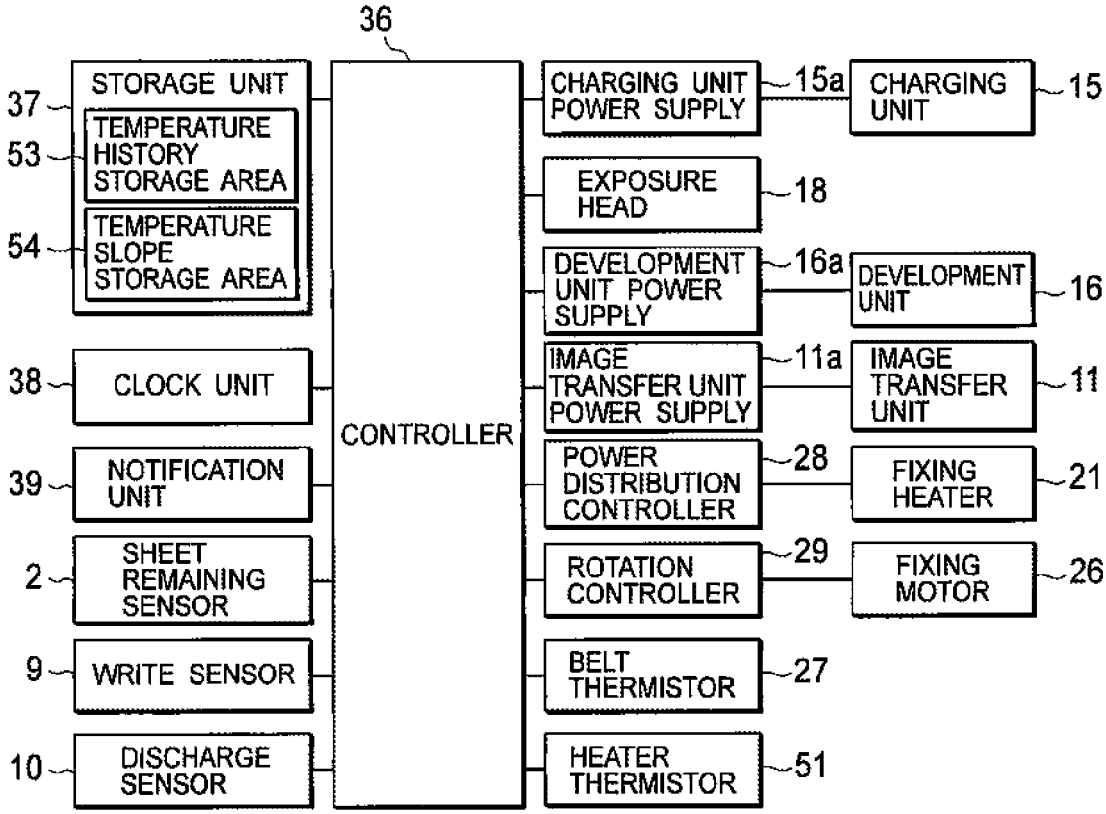

FIG. 10 is a block diagram of a printer of the second embodiment.

Figure 11:
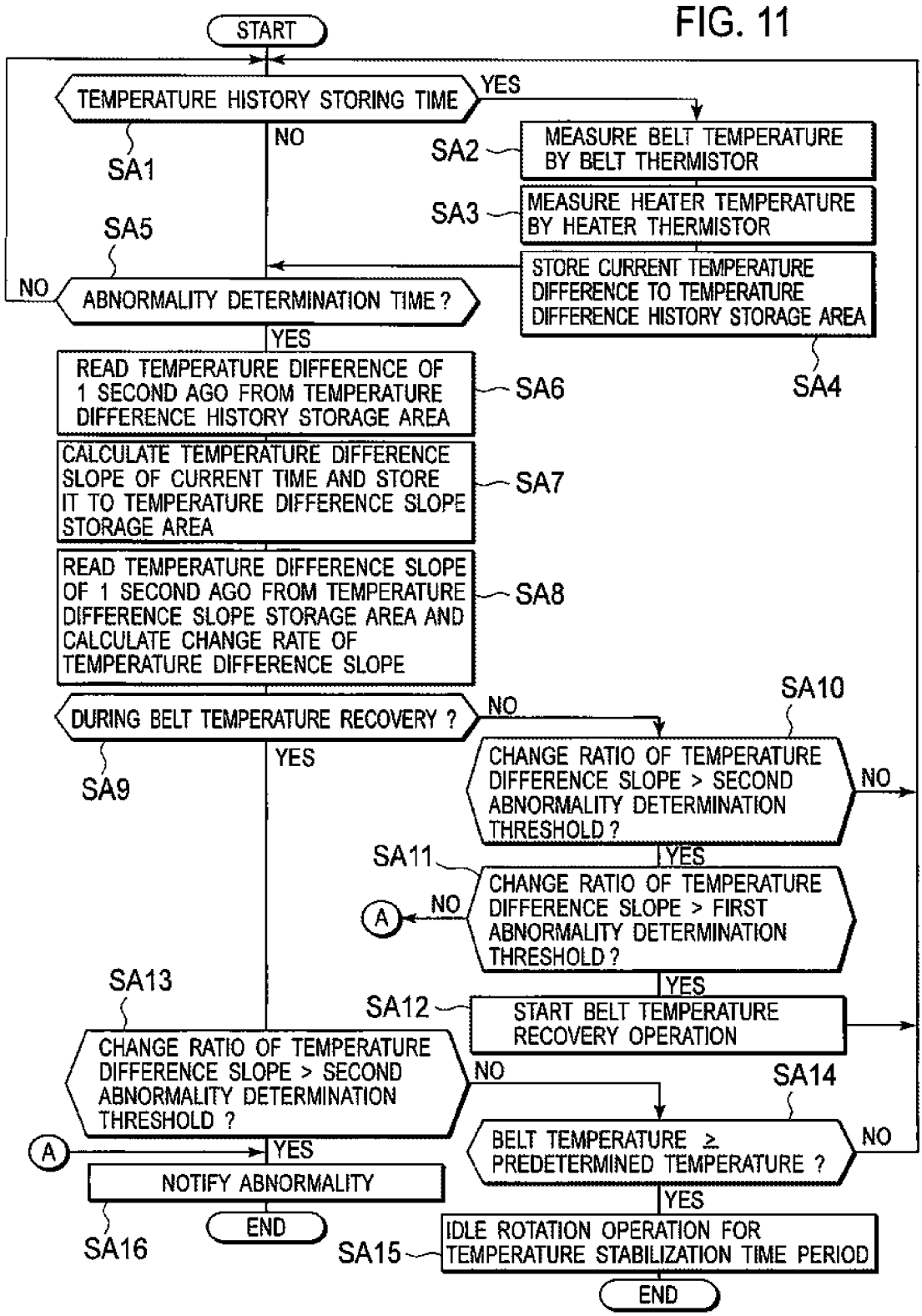

FIG. 11 is a flow chart showing an abnormality detection process of the second embodiment.

FIGS. 12A, 12B, 12C, and 12D show the change ratio of the temperature difference slope when poor contact occur in the fixing unit according to the second embodiment.

DETAILED DESCRIPTION OF THE EMBODIMENTS

Descriptions are provided herein below for embodiments based on the drawings. In the respective drawings referenced herein, the same constituents are designated by the same reference numerals and duplicate explanation concerning the same constituents is omitted. All of the drawings are provided to illustrate the respective examples only.

Hereinafter, a heating device and an image forming apparatus according to the embodiments of the invention will be described with reference to the drawings.

[First Embodiment]

Figure 1:
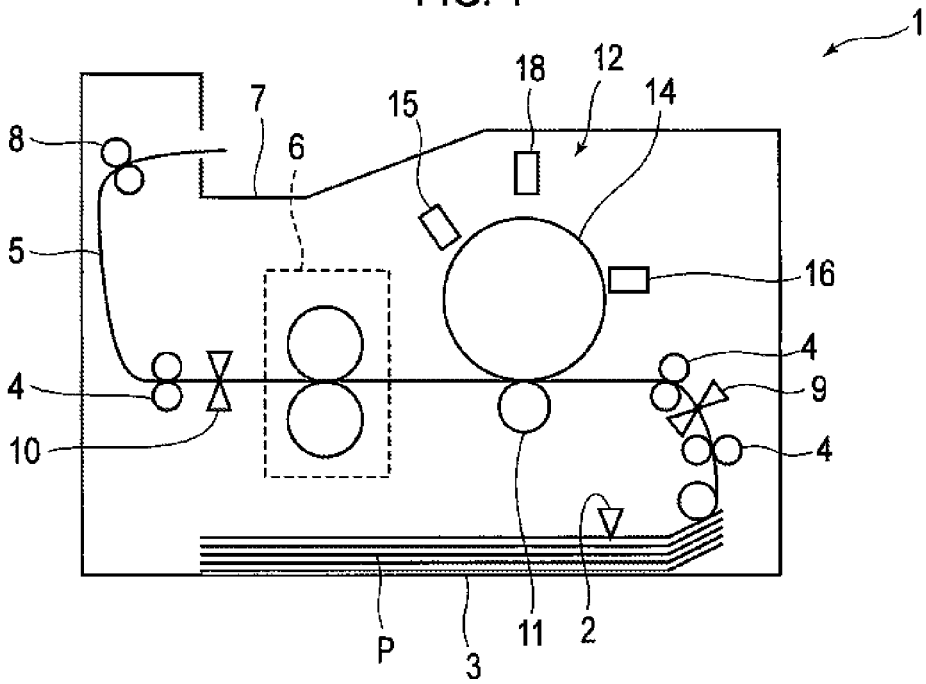
FIG. 1 is a side view of a schematic configuration of a first embodiment according to the invention.
Figure 2:
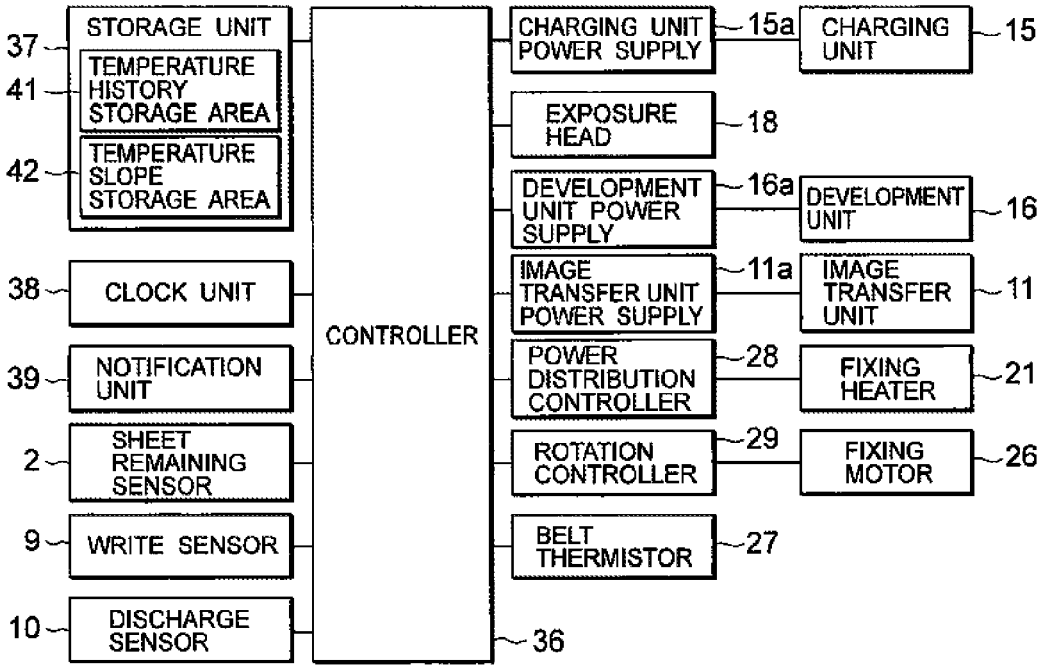
FIG. 2 is a block diagram of a printer of the first embodiment.

In FIGS. 1 and 2, reference number 1 represents an electrophotographic printer as an image forming apparatus. Printer 1 includes therein substantially S-shaped conveying path 5 extending from sheet cassette 3, which has sheet remaining sensor 2 and contains therein sheets P (serving as printable media). Sheets P are transported one by one from sheet cassette through conveying path 5 to stacker 7 by conveying rollers 4 and the like. Fixing unit 6, which functions as a heating device and is configured to fix a toner image to sheet P by heating and pressing the toner image on sheet P, and discharging roller 8, which discharges sheet P that the toner image is fixed on to stacker 7, are provided along sheet conveying path 5.

Also write sensor 9, which is provided downstream from sheet cassette 3 in the conveying direction of sheets P and is used for determining the timing of transferring the toner to sheet P, and discharge sensor 10, which is provided downstream of fixing unit 6 in the conveying direction and is used for determining the timing of stopping the operation of fixing unit 6 by detecting sheet P on which the toner image was fixed by the fixing unit 6, are provided along sheet conveying path 5. Between discharge sensor 10 downstream of fixing unit 6 and write sensor 9 upstream of fixing unit 6, image forming unit 12 is provided at a position opposite to image transfer unit 11, which includes image transfer rollers, across sheet conveying path 5. Image forming unit 12 includes an un-illustrated toner cartridge (developer cartridge) containing therein toner (developer).

Image forming unit 12 includes: photosensitive drum 14 as an image carrier; charging unit 15 including a charging roller configured to uniformly charge photosensitive drum 14 by a voltage supplied from charging unit power supply 15*a*; development unit 16 including a supplying roller and a development roller configured to attach the toner onto photosensitive drum 14 by a voltage supplied from development unit power supply 16*a*; and the like. Exposure head 18 (an exposure unit) including a LED array (Light Emitting Diode) is provided facing to photosensitive drum 14 and configured to emit light onto photosensitive drum 14 to form a latent image on photosensitive drum 14. Image forming unit 12 functions to form a toner image (a developer image) on photosensitive drum 14 by attaching toner to the latent image on photosensitive drum 14 from the development roller of development unit 16. The toner image on photosensitive drum 14 is transferred to sheet P with a voltage supplied from image transfer unit power supply 11*a*.

Figure 3:
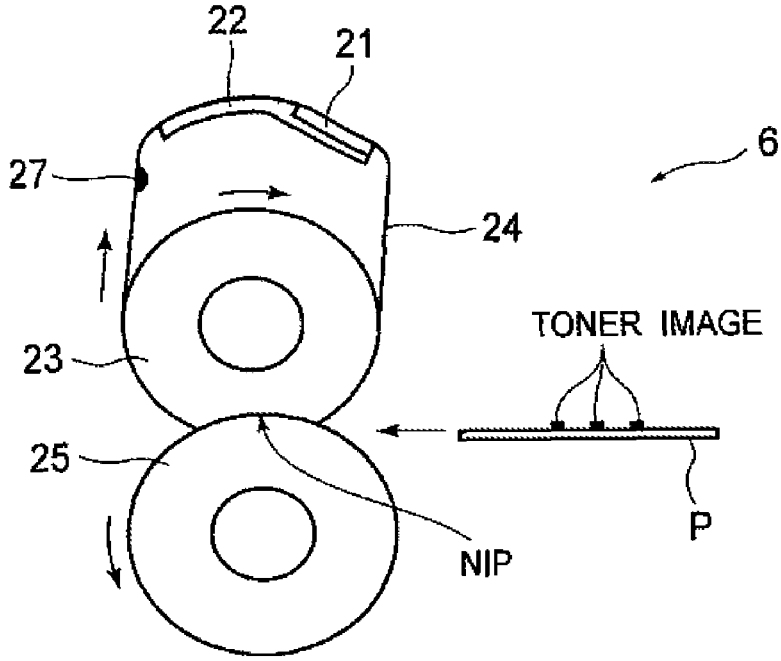
FIG. 3 is a side view of a schematic configuration of a fixing unit of the first embodiment.

As shown in FIG. 3, in this embodiment, fixing unit 6 includes: fixing heater 21 (a heater); heater holder 22 (a supporting member) supporting fixing heater 21; upper pressure roller 23 including an elastic member, such as rubber, on the outer circumference of the upper pressure roller 23; fixing belt 24 (a heat transfer member); lower pressure roller 25 serving as a driving member; fixing motor 26 (see FIG. 2), serving as a driver configured to rotationally drive lower pressure roller 25; a belt temperature measuring thermistor (hereinafter referred to as belt thermistor 27), serving as a temperature detector, provided in contact with the inner circumferential surface of fixing belt 24 and configured to measure the temperature of fixing belt 24 (hereafter, referred to as belt temperature); power distribution controller 28 (see FIG. 2) configured to control an amount of electronic current to be supplied to fixing heater 21; rotation controller 29 configured to control the rotation of fixing motor 26; and the like.

Upper pressure roller 23 and fixing heater 21 are provided inside fixing belt 24 and in contact with the inner circumferential surface of fixing belt 24, such that fixing belt 24 extends between and is guided around upper pressure roller 23 and fixing heater 21. Lower pressure roller 25 is provided in contact with the outer circumferential surface of fixing belt 24 and opposite to upper pressure roller 23 across fixing belt 24.

Lower pressure roller 25 is rotationally driven by fixing motor 26 with un-illustrated gears or the like and is pressed against upper pressure roller 23 via fixing belt 24 by an un-illustrated pressure biasing member such as a spring. When lower pressure roller 25 rotates with fixing motor 26 by instruction from rotation controller 29, the rotation of lower pressure roller 25 is transferred to upper pressure roller 23 and fixing belt 24, which are pressed by lower pressure roller 25 by means of the bias pressure of the pressure biasing member. That is, fixing belt 24 and upper pressure roller 23 are rotationally driven by the rotation of lower pressure roller 25.

Although fixing belt 24 and upper pressure roller 23 can be referred to as driven members in fixing unit 6, only fixing belt 24 in this embodiment, which is a member directly in contact with lower pressure roller 25 (a driving member) corresponds to a driven member according to the invention.

In this embodiment, belt thermistor 27 is disposed at the center portion of the width of fixing belt 24, the width direction of fixing belt 24 being orthogonal to a direction in which fixing belt 24 moves.

Figure 4:
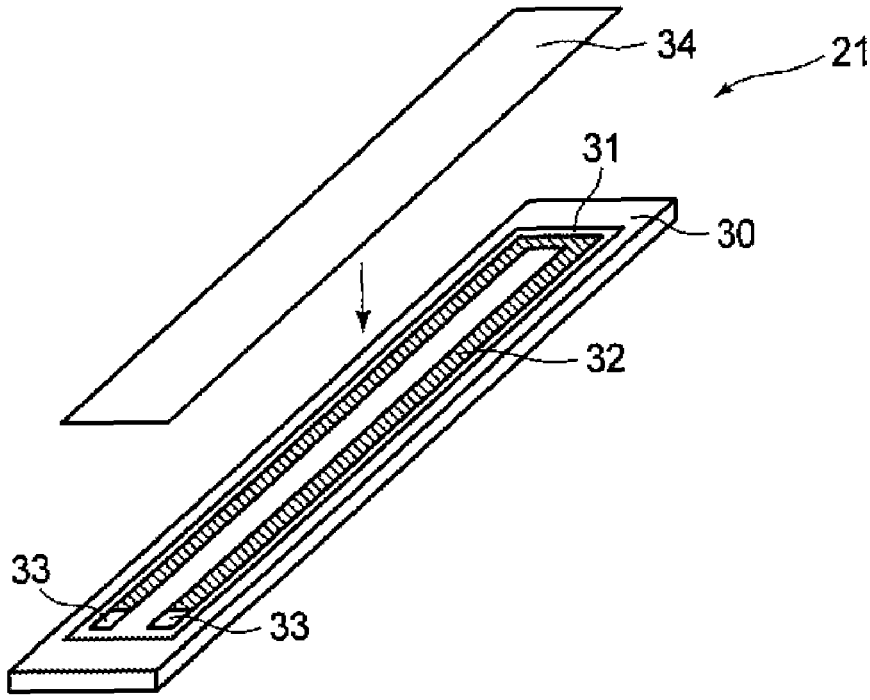
FIG. 4 is an explanatory view of a fixing heater of the first embodiment.

Fixing heater 21 is a sheet heating element extending in the width direction of fixing belt 24. As shown in FIG. 4, fixing heater includes: base plate 30 made of stainless steel (SUS430), for example; electric insulating layer 31 such as a thin glass membrane formed on base plate 30; U-shaped resistance heating element 32 (see hatching in FIG. 4) which is formed on electric insulating layer 31 by applying a paste of nickel-chromium (Ni—Cr) alloy powder or silver-palladium (Ag—Pd) alloy powder on electric insulating layer 31 by screen printing; electrodes 33 formed at both ends of resistance heating element 32 and made of a chemically-stable metal having a low electric resistance such as silver or a high melting point metal such as tungsten (W); and protective layer 34 conveying the entire surface including base plate 30, electric insulating layer 31, resistance heating element 32, and electrodes 33 and made of glass or typical fluorine containing resin such as polytetrafluoroethylene (PTFE), perfluoro-alkoxyalkane (PFA), or fluorinated ethylene propylene copolymer (FEP). Fixing heater 21 is disposed such that the heated surface (the surface on the side of protective layer) is in slidably contact with fixing belt 24. Accordingly, upon energizing resistance heating element 32 with power distribution controller 28, the heat of resistance heating element 32 is transferred to fixing belt 24 through the contact between fixing belt 24 and the heated surface of fixing heater 21.

In FIG. 2, reference number 36 represents a controller of printer 1. Controller 36 includes a microprocessor, a ROM (Read Only Memory), a EEPROM (Electrically erasable and Programmable ROM (nonvolatile storage)), a RAM (Random Access Memory), input-output ports (I/O ports), and the like. Controller 36 is connected to information process apparatus (external apparatuses or host apparatuses) such as personal computers and controls the components in printer 1 so as to execute the image forming process and the like.

Note that the solid lines in FIG. 2 illustrate connections between controller 36 and the components.

Reference number 37 represents a storage unit in printer 1 storing therein programs executed by controller 36, various types of data used for the programs, and process results executed by controller 36.

Reference number 38 represents a clock unit. Clock unit 38 includes a frequency generator having a crystal oscillator or the like and configured to count time based on the frequency generated by the frequency generator and outputs a temporal signal of the counted time.

Reference number 39 represents a notification unit. Notification unit 39 includes: a speaker configured to convert sound data of a warning tone, voice, or the like that are created by controller 36 into sounds and transmits the sound to the outside; a display screen to show messages such as a warning message; and the like.

Next, the image forming process of printer 1 according to the embodiment will be described.

Controller 36 of printer 1 waits for reception of a print instruction, including a control signal showing a page configuration or the like and video signal having an array of bitmap data or the like, from the information process apparatus. When receiving the print instruction from the information process apparatus, controller 36 starts executing the image forming process.

Upon receiving the print instruction, in order to control the temperature of fixing unit 6, controller 36 rotates fixing motor 26 by rotation controller 29, detects the belt temperature (temperature of fixing belt 24 in fixing unit 6 having fixing heater 21) by belt thermistor 27, and determines whether the belt temperature is in a predetermined fixable temperature range. When the belt temperature is lower than the predetermined temperature range, controller 36 energizes fixing heater 21 with power distribution controller 28 to heat fixing belt 24 to the predetermined fixable temperature range. After determining that fixing belt 24 is in the predetermined fixable temperature range, controller 36 executes the following printing process while maintaining the temperature of fixing unit 6 within the predetermined temperature range.

Namely, controller 36 detects with sheet remaining sensor 2 whether sheet P is set in sheet cassette 3. When detecting sheet P that has an appropriate size for printing, controller 36 feeds sheet P of the appropriate size from sheet cassette 3 to sheet conveying path toward image forming unit 12.

When sheet P is detected by write sensor 9 after sheet P is fed into sheet conveying path 5 toward image forming unit 12, controller 36 energizes charging unit 15 with charging unit power supply 15*a* to charge the surface of photosensitive drum 14 to a predetermined electric potential (for example, −600 V) and instructs exposure head 18 to irradiate imaging light to the negatively charged surface of photosensitive drum 14 at a timing corresponding to print data generated by an un-illustrated print data generating unit based on the received the control signal and the video signal, to shift the electric potential of the imaged area on the negatively charged surface of photosensitive drum 14 to a electric potential (for example, −50 to 0 V), thereby forming a latent image.

Then, development unit 16 energized by development unit power supply 16 attaches negatively-charged toner to the latent image by electrical attraction, thereby forming a toner image on the surface of the photosensitive drum 14.

As photosensitive drum 14 rotates, the toner image on the surface of photosensitive drum 14 moves to a position facing image transfer unit 11 and is transferred onto sheet P by electric attraction caused by a voltage (for example, +2000 to +3000 V) that is supplied to image transfer unit 11 from image transfer unit power supply 11*a*.

After transferring the toner image to sheet P, controller 36 conveys sheet P to fixing unit 6 having fixing heater 21 therein, fixes the toner image to sheet P by heat and pressure in fixing unit 6, further conveys sheet P on which the toner image is fixed along sheet conveying path 5, and discharges sheet P to stacker 7 of printer 1 by discharging roller 8.

When discharge sensor 10 detects that all sheets P, on each of which the toner image is fixed, are discharged to stacker 7, controller 36 instructs rotation controller 29 to stop rotation of fixing motor 26 and instructs power distribution controller 28 to stop the power supplied to fixing heater 21.

Next, heat transfer in fixing unit 6 incorporating fixing heater 21 therein will be described.

When controller 36 instructs power distribution controller 28 to supply power to fixing unit 6 to heat fixing heater 21, heat is generated by fixing heater 21. Heat is continuously transferred from the heated surface of fixing heater 21 to fixing belt 24 that is in slide-contact with the heated surface of fixing heater 21, thereby increasing the temperature of fixing belt 24.

At the same time, controller 36 instructs rotation controller 29 to rotate fixing motor 26. The rotation of fixing motor 26 is transferred to lower pressure roller 25 via gears (not shown) so that lower pressure roller 25 rotates. The rotation of lower pressure roller 25 rotates upper pressure roller 23, against which lower pressure roller 25 is biased by the pressure biasing member (not shown) as fixing belt 24 runs between upper pressure roller 23 and fixing heater 21.

Here, fixing belt 24 is heated by fixing heater 21 at a position where fixing belt 24 is in slide-contact with fixing heater 21. As fixing belt 24 rotates, the heated portion of fixing belt 24 moves to a contact point between fixing belt 24 and upper pressure roller 23 and is transferred to upper pressure roller 23 at the contact, since upper roller 23 has no heater the inside or the outside thereof and has a lower temperature than fixing heater 21 and fixing belt 24.

As fixing motor 26 further rotates, the heated portion of fixing belt 24 moves to a nip between upper pressure roller 23 and lower pressure roller 25 so that the heat is transferred from fixing belt 24 to sheet P, which has a lower temperature than fixing belt 24, at the nip.

In such continuous movements, the heat generated by fixing heater 21 is transferred to sheet P by means of fixing belt 24, so that the toner image is fixed to sheet P by the heat supplied from fixing belt 24 and the pressure applied from the pressure biasing member.

As fixing belt 24 further rotates, the portion of fixing belt 24 whose heat is transferred to sheet P moves toward fixing heater 21, and the inner circumferential surface of the portion is measured by belt thermistor 27 at a position where fixing belt 24 is in slide contact with belt thermistor 27.

In this way, the toner fixing operation by fixing unit 6 of this embodiment is executed.

Slip of fixing belt 24, which is a condition where the driving force of lower pressure roller 25 is not transferred to upper pressure roller 23 via fixing belt 24, during the toner fixing operation, will be described.

As described above, in fixing unit 6 of this embodiment, fixing belt 24 transports the heat generated by fixing heater 21 to the position to be in contact with sheet P.

Here, the driving force of lower pressure roller 25, which is transmitted from fixing motor 26 to lower pressure roller 25, might not be transferred to fixing belt 24 and/or upper pressure roller 23. If the hardness of upper pressure roller 23 is non-uniform, has a partial low portion, or the like, due to the hardness distribution of the elastic member of upper pressure roller 23 caused by the characteristics of upper pressure roller 23 under a low temperature condition (for example, in the pre-heating operation), the pressure between upper pressure roller 23 and lower pressure roller 25 decreases partially and the friction between fixing belt 24 and lower pressure roller 25 decreases partially, so that the driving force may not be transferred to fixing belt 24, causing a slip of fixing belt 24.

Next, a process for detecting an abnormality due to such a slip will be described.

A print operation execution program is stored in advance in storage unit 37 of printer 1 of the embodiment. The print operation execution program includes an application program for executing an abnormality detection process (to be explained later with reference to FIG. 5) or the like, in addition to a normal image forming process execution program for executing the normal printing operation. Note that steps of the print operation execution program executed by controller 36 comprise un-illustrated functional units of printer 1 in this embodiment.

Also stored in storage unit 37 in advance are an abnormality determination threshold, a temperature history storing time, an abnormality determination time, a time interval ΔT used for calculating a change ratio, and a temperature stabilization time period. The abnormality determination threshold is a predetermined value used for detecting an abnormality due to a slip of fixing belt 24. The temperature history storing time is a predetermined interval (10 ms in this embodiment) at which the history of the belt temperature is periodically stored. The abnormality determination time is a predetermined interval (0.1 second in this embodiment) at which an occurrence of a slip of fixing belt 24 is periodically judged. The time interval ΔT is a predetermined length of time (one second in this embodiment) used for calculating temperature slope K and change ratio Dk of the temperature slope (to be described later) for judging whether or not a slip of fixing belt 24 occurs. The temperature stabilization time period (30 seconds in this embodiment) is a predetermined time period during which fixing unit 6 is driven idle for stabilizing the temperature of upper pressure roller 23 after the belt temperature is recovered to a predetermined fixable temperature (for example, 160° C.) by a belt temperature recovery operation after it had been determined that the slip had occurred.

In addition, temperature history storage area 41 and temperature slope storage area 42 are provided in storage unit 37 in advance. Temperature history storage area 41 is for the temperature history information, in which the belt temperatures detected by belt thermistor 27 at the predetermined intervals (at each temperature history storing time) are stored. Temperature slope storage area 42 is for the temperature slope information, in which change ratios of the temperature of fixing belt 24 with time, which are referred to as temperature slopes K, are stored for detecting a slip of fixing belt 24.

By means of software of the print operation execution program in the abnormality determination process, controller 36 of printer 1 forms therein: a functional unit that calculates, based on the belt temperature history, temperature slope K, which is a velocity of the temperature change; a functional unit (a calculator in this embodiment) that calculates change ratio DK of the temperature slope between the current time and one second (ΔT) before the current time, which is an acceleration of the temperature change; and a functional unit (a determiner in this embodiment) that compares change ratio DK of the temperature slope with the abnormality determination threshold and determines whether a slip of fixing belt 24 occurs. Note that ΔT is the time interval used for calculating the change ratio and equals one second in this embodiment.

In the embodiment, temperature change amount ΔS of the belt temperature with time is calculated by the following formula (1). In the formula (1), Sb0 represents the belt temperature detected by belt thermistor 27 at the current time (that is, a current temperature), and Sb1 represents the measured belt temperature one second (ΔT) prior to the current time, which was stored in temperature history storage area 41 in storage unit 37. ΔT is the time interval used for calculating the change ratio and equals one second in this embodiment.

$$\Delta S = Sb0 - Sb1 [^\circ \text{ C.}] \quad (1)$$

Temperature slope K between the times, that is, a first order differential value of change of the belt temperature Sb with respect to time, is calculated by the following formula (2).

$$K = \Delta S / \Delta T [^\circ \text{ C./s}] \quad (2)$$

Change amount AK of the temperature slope with time is calculated by the following formula (3). In the following formula (3), K0 represents the temperature slope of the current time that is calculated by the formula (2). In the following formula (3), K1 represents the temperature slope one second before the current time, which was calculated and stored in temperature slope storage area 42 of storage unit 37. In this embodiment, temperature slope K1 is the temperature slope of the temperature change between two seconds ago and one second ago.

$$\Delta K = K0 - K1 [^\circ \text{ C./s}] \quad (3)$$

Change ratio DK of the temperature slope, that is, a second order differential value of change of the belt temperature Sb with time, is calculated by the following (4).

$$DK = \Delta K / \Delta T [^\circ \text{ C./s}^2] \quad (4)$$

Relationships between temperature slope K and change ratio DK of the temperature slope will be described with reference to FIGS. 6A to 7C.

FIGS. 6A, 6B and 6C show the normal operation, in which no abnormalities occur: FIG. 6A shows the temperature of fixing heater 21 and the belt temperature detected by belt thermistor 27; FIG. 6B shows temperature slope K of the belt temperature (the change ratio of the temperature of fixing belt 24 with time); FIG. 6C shows change ratio DK of the temperature slope of the belt temperature.

As shown in FIG. 6A, in the case where fixing belt 24 operates normally, the belt temperature increases as the temperature of fixing heater 21 increases. When the belt temperature reaches the predetermined fixable temperature, the belt temperature is maintained to a certain level by the control of power distribution controller 28, and then, when fixing heater 21 is turned off, the belt temperature decreases by heat radiation.

As shown in FIG. 6B, in the case where fixing belt 24 operates normally, temperature slope K of the belt temperature increases at a constant ratio in the initial stage of heating, and then stays at a constant value. After the fixing heater 21 is turned off, temperature slope K of the belt temperature decreases at a constant ratio.

Therefore, as shown in FIG. 6C, change ratio DK of the temperature slope of the belt temperature stays at a substantially constant value, that is, in a certain range (for example, $-3°$ C./s$^2$ to $+3°$ C./s$^2$) from the initial stage to the turn-off of the heating.

FIGS. 7A, 7B and 7C show the case where slip between fixing belt 24 and lower pressure roller 25 occurs intermittently; FIG. 7A shows the temperature of fixing heater 21 and the belt temperature detected by belt thermistor 27, FIG. 7B shows temperature slope K of the belt temperature, and FIG. 7C shows change ratio DK of the temperature slope of the belt temperature.

As shown in FIG. 7A, even in the case where slip of fixing belt 24 occurs, the belt temperature changes like the temperature change in the normal operation shown in FIG. 6A. That is, no abnormal temperature changes or the like can be observed in FIG. 7A.

As shown in FIG. 7B, in the case where slip of fixing belt 24 occurs, rapid changes of temperature slope K of the belt temperature are observed when the slips occur. However, temperature slope K of the belt temperature exists in the substantially same range as the normal operation shown in FIG. 6B, therefore, it is difficult to determine whether a slip occurs (or the normal operation).

As shown in FIG. 7C, when slip occurs, change ratio DK of the temperature slope of the belt temperature goes down and up rapidly and exceeds a range in which change ratio DK in the normal operation shown in FIG. 6C exists. Therefore, it is possible to detect the slip based on change ratio DK.

That is, it is found that the occurrence of slip is detected with accuracy by observing change ratio DK of the temperature slope and comparing change ratio DK to a predetermined value (the abnormality determination threshold).

In the embodiment, the abnormality determination threshold stored in storage unit 37 is set to a range, obtained by experiment, of change ratio DK of the temperature slope. For example, the abnormality determination threshold is set in a range from $-4°$ C./s$^2$ to $+4°$ C./s$^2$ (hereinafter referred to as $\pm 4°$ C./s$^2$, see FIG. 6C). When change ratio DK of the temperature slope exceeds the upper limit or the lower limit of the range of the abnormality determination threshold, it is determined that an abnormality due to a slip occurs.

Next, steps of the abnormality detection process of this embodiment will be described with reference to the flow chart of FIG. 5.

When the main power supply of printer 1 is turned on, the print operation execution program stored in storage unit 37 in printer 1 is automatically activated; controller 36 puts the components of printer 1 in the idle operation by the print operation execution program and waits for a print instruction from the information process apparatus. When receiving the print instruction, controller 36 starts executing the above described image forming process and starts the temperature control of fixing unit 6 based on the belt temperature measured based on an output of belt thermistor 27.

Step S1: After starting the abnormality detection process, in order to obtain data of the temperature of fixing belt 24, which are fundamental data to detect slip, controller 36 reads out the temperature history storing time (10 ms, in this embodiment) from storage unit 37, waits for the next temperature history storing time by using clock unit 38, and proceeds to step S2 when the temperature history storing time occurs but proceeds to step S4 before the temperature history storing time occurs.

Step S2: After determining that the temperature history storing time occurs, controller 36 recognizes the current time by using clock unit 38 and measures the current temperature of fixing belt 24 based on the output of belt thermistor 27.

Step S3: After measuring the current temperature of fixing belt 24, controller 36 stores the measured current temperature of fixing belt 24 with the recognized current time, as the temperature history information, to temperature history storage area 41 of storage unit 37 in chronological order, in order to make the fundamental data to detect a slip. Then, controller 36 proceeds to step S4.

The temperature history information is updated in turn, so that the temperature history information in a predetermined elapsed period (for example, one second) are stored in temperature history storage area 41.

That is, the temperature history information stored in temperature history storage area 41 of storage unit 37 is to be used to detect a slip.

Step S4: In order to determine whether slip of fixing belt 24 of fixing unit 6 occurs, controller 36 reads out the abnormality determination time (0.1 second in this embodiment) stored in storage unit 37, monitoring an arrival of the abnormality determination time with clock unit 38, and proceeds to step S5 when the abnormality determination time occurs.

When the abnormality determination time does not occur, controller 36 proceeds back to step S1, to continue monitoring an arrival of the temperature history storing time in step S1 and an arrival of the abnormality determination time in step S4.

Step S5: After determining that the abnormality determination time occurs, in order to calculate temperature slope K of the belt temperature, controller 36 reads out the time interval $\Delta T$ (one second in this embodiment) stored in storage unit 37. Then controller reads out from temperature history storage area 41 of storage unit 37, based on this time interval, belt temperature S1 (a first temperature according to this embodiment) one second before the current time. Here, the current time is a time that was recognized in the last step S2 just before the arrival of the abnormality determination time.

Step S6: Controller 36 calculates temperature slope K0 of the current time by means of the formula (2) with current temperature S0 measured in step S2 (a second temperature according to this embodiment), belt temperature S1, and the time length ($\Delta T$). Controller 36 then stores calculated temperature slope K0 with the current time, as temperature slope information, to temperature slope storage area 42 of storage unit 37.

Step S7: After storing the temperature slope information of the current time, controller 36 reads out temperature slope K1, which is temperature information from one second before the current time, from temperature slope storage area 42 of storage unit 37, in order to calculate change ratio DK of the temperature slope of the belt temperature.

Then controller 36 (serving as a calculator in the embodiment) calculates change ratio DK of the temperature slope, by means of the above formula (4), with temperature slope K0 of the current time, temperature slope K1, and time interval ΔT.

Step S8: After calculating change ratio DK of the temperature slope, controller 36 determines whether the current operation is a belt temperature recovery operation (see step S10). When the current operation is a belt temperature recovery operation, controller 36 proceeds to step S11 to detect a slip in the belt temperature recovery operation.

When the current process is not a belt temperature recovery operation, that is, when the current process is a fixing operation of fixing unit 6, controller 36 proceeds to step S9.

Step S9: After determining that the current process is the fixing operation of fixing unit 6, in order to determine whether a slip occurs in the fixing operation, controller 36 reads the abnormally determination threshold (±4° C./s$^2$ in this embodiment) stored in storage unit 37. Controller (serving as a determiner according to this embodiment) compares the calculated change ratio DK of the temperature slope with the abnormality determination threshold and proceeds to step S10 when change ratio DK of the temperature slope exceeds the upper limit or the lower limit of the range of the abnormality determination threshold, that is, when it is determined that a slip occurs in the fixing operation.

When change ratio DK of the temperature slope does not exceed the upper limit or the lower limit of the range of the abnormality determination threshold, controller 36 determines that no abnormalities occurred, that is, determines that fixing unit 6 operates normally and proceeds back to step S1 to continue monitoring by steps S1 and S4.

Step S10: After determining that a slip occurs in the fixing operation, controller 36 stops the processing image forming process having been executed in parallel and starts a belt temperature recovery operation of fixing unit 6, in which fixing motor 26 is rotated without conveyance of sheet P through fixing unit 6 while controlling the temperature of fixing unit 6, to recover the belt temperature to the predetermined fixable temperature (160° C. in this embodiment). Then, controller 36 proceeds back to step S1 to continue steps S1 to S8 executing a process of obtaining temperature history information and a process of calculating change ratio DK of the temperature slope.

Step S11: After determining that the current process is a belt temperature recovery operation of fixing unit 6, in order to determine whether a slip occurs in the belt temperature recovery operation, controller 36 compares change ratio DK of the temperature slope with the abnormality determination threshold, like the above described step S9. When change ratio DK of the temperature slope exceeds the upper limit or the lower limit of the range the abnormality determination threshold, controller 36 determines that a slip occurs in the belt temperature recovery operation and proceeds to step S14.

When change ratio DK of the temperature slope does not exceed the upper limit or the lower limit of the range of the abnormality determination threshold, controller 36 determines that the belt temperature recovery operation is executed normally and proceeds to step S12.

Step S12: After determining that the belt temperature recovery operation is executed normally, controller 36 measures the belt temperature based on the output of belt thermistor 27. When the measured belt temperature is equal to or greater than the predetermined fixable temperature, controller 36 proceeds to step S13.

When the measured belt temperature is less than the predetermined fixable temperature, controller 36 proceeds back to step S1 to continue steps S1 to S8 executing the process of obtaining temperature history information and the process of calculating change ratio DK of the temperature slope, while continuing the belt temperature recovery operation.

Step S13: After determining that the belt temperature is equal to or greater than the predetermined fixable temperature, in order to stabilize the temperature of upper pressure roller 23, controller 36 reads out the temperature stabilization time period (30 seconds in this embodiment) stored in storage unit 37 and executes an idle rotation operation of fixing unit 6, in which fixing motor 26 is rotated without transporting sheets P through fixing unit 6 while the belt temperature is controlled to the predetermined fixable temperature range, while monitoring with clock unit 38 whether the temperature stabilization time period elapses. Controller 36 continues the idle rotation operation when the elapsed time is less than the temperature stabilization time period. Controller 36 resumes executing parallel processing of the image forming process when the elapsed time is equal or greater than the temperature stabilization time period.

In such an idle rotation operation of fixing unit 6, heat, which is supplied to upper pressure roller 23 from fixing heater 21 via fixing belt 24, gradually moves from the surface to the inside of upper pressure roller 23. Thus, the elastic member of upper pressure roller 23 is entirely heated and the hardness of the elastic member of upper pressure roller 23 is decreased, so that contact between upper pressure roller 23 and lower pressure roller 25 via fixing belt 24 stabilizes. Accordingly, the rotational driving force from lower pressure roller 25 is stably transmitted to upper pressure roller 23, thereby preventing the occurrence of slip of fixing belt 24.

Step S14: After determining that a slip occurs in the belt temperature recovery operation, controller 36 stops operation of the components of printer 1 including fixing heater 21 and fixing motor 26 of fixing unit 6 and notifies the operator of the occurrence of the abnormality by sounding a warning tone with notification unit 39 and displaying a message prompting the operator to check the cause of an abnormality with the display screen, in order to notify the operator of a possibility of the occurrence of an abnormality due to the other causes, which is not a recoverable abnormality due to the high hardness of the elastic member of upper pressure roller 23 of fixing unit 6. Then, controller 36 ends the image forming process and the abnormality detection process.

In this way, the abnormality detection process according to the embodiment is executed.

Note that the following is the reason why controller 36 stops printer 1 and notifies the operator of the abnormality in step S14 after determining that a slip occurs again in the belt temperature recovery operation in step S11.

In this embodiment, printer 1 uses fixing heater 21 to heat fixing belt 24 to control the temperature of fixing belt 24, which directly heats sheet P, to the predetermined temperature. If a poor contact between belt thermistor 27 and fixing belt 24 occurs, for example, the temperature detected by belt thermistor 27 is less than the actual temperature of fixing belt 24.

FIG. 8*b* shows change ratio DK of the temperature slope calculated based on the temperature detected by belt thermistor 27 in the case where such poor contact between belt thermistor 27 and fixing belt 24 (hereinafter referred to as poor contact of belt thermistor 27) occur.

FIGS. 8*a* and 8B show the case where the poor contact of belt thermistor 27 intermittently occurs: FIG. 8A shows changes of the temperature of fixing heater 21 and the belt temperature detected by belt thermistor 27, and FIG. 8B shows change ratio DK of the temperature slope of the belt temperature detected by belt thermistor 27.

As shown in FIG. 8A, even through poor contact of belt thermistor 27 occurs, the belt temperature detected by belt thermistor 27 changes like the temperature change in the normal operation shown in FIG. 6A. That is, no abnormal temperature changes or the like can be observed in FIG. 8A.

As shown in FIG. 8B, when poor contact of belt thermistor 27 occurs, change ratio DK of the temperature slope of the belt temperature changes exceeding the range in which change ratio DK of the temperature slope in the normal operation shown in FIG. 6C exists. However, such change of change ratio DK in the case where poor contact occurs shown in FIG. 8B is similar to the change of change ratio DK in the case where the slips occur shown in FIG. 7C. Thus, upon trying to detect the occurrence of a slip of fixing belt 24 based on change ratio DK, which is calculated based on the belt temperature detected by belt thermistor 27, it is difficult to distinguish the occurrence of a slip of fixing belt 24 from the occurrence of a poor contact of belt thermistor 27.

Accordingly, when the occurrence of slip is detected in the belt temperature recovery operation in above described step S11, this embodiment stops the operation of printer 1, informs the operator of the occurrence of the abnormality, and urges the operator to investigate the cause of the abnormality.

Since the temperature detected by belt thermistor 27 is lower than the actual temperature of fixing belt 24 as described above, if controller 36 did not stop printer 1 and did continue the recovery operation when a poor contact of belt thermistor 27 occurred, controller 36 would supply excessive electronic power to fixing heater 21 with power distribution controller 28 and the overheating by fixing heater 21 would thus damage fixing unit 6, for example, fixing belt 24 which is in slide-contact with fixing heater 21.

As described above, in the abnormality detection process, this embodiment detects a slip of fixing belt 24 based on change ratio DK of the temperature slope, which is a second order differential value of change of the belt temperature with time. Therefore, this embodiment detects the occurrence of a slip in fixing unit 6 with high accuracy and thus can prevent damage of fixing unit 6 such as damage of fixing belt 24 caused by the overheating of fixing heater 21, thereby improving the safety of printer 1.

If a portion of fixing belt 24 was overheated due to a slip, toner would be adhered to the overheated portion of fixing belt 24 upon fixing the toner image to sheet P, and would deteriorate the print quality. However, this embodiment detects the occurrence of a slip in fixing unit 6 with high accuracy in the abnormality detection process, and thus prevents the overheat and the toner adhesion on fixing belt 24 caused by the slip, thereby stabilizing the print quality.

Further, this embodiment stops the operation of printer 1 when the occurrence of a slip is detected in the belt temperature recovery operation. Therefore, this embodiment prevents damage of fixing unit 6 such as the damage of fixing belt 24 caused by overheating of fixing heater 21, thereby further improving the safety of printer 1.

To summarize, this embodiment stores in the storage unit the temperature history information of the belt temperature detected by the belt thermistor and calculates temperature slope K, which is the first order differential value of change of the belt temperature with respect to time. Calculation of the temperature slope K is based on the belt temperature S0 recorded at the current time and the belt temperature S1 recorded the time interval ΔT before the current time. Then, change ratio DK of the temperature slope is calculated. Change ratio DK is the second order differential value of the change of the belt temperature with time and is based on K0, the value of temperature slope K at the current time, and K1, the value of temperature slope K at the time interval ΔT before the current time. The occurrence of a slip of the fixing belt is detected when change ratio DK exceeds the range of the abnormality determination threshold. Therefore, this embodiment easily detects the occurrence of an abnormality due to a slip in the fixing unit. Accordingly, this embodiment can prevent damage of the fixing unit such as damage of the fixing belt caused by overheating of the fixing heater and prevents toner adhesion on the fixing belt caused by overheating of the fixing belt due to the slip, thereby stabilizing the print quality.

Note that although this embodiment informs the operator of the occurrence of an abnormality when a slip is detected one time in the recovery operation, a modification may inform the operator of an abnormality when a slip occurs plural times (for example, 10 times) within a predetermined time period (for example, 30 seconds) in the recovery operation or when a slip continues for a predetermined time period (for example, one second) or more.

[Second Embodiment]

In a second embodiment, the same constituents as the first embodiment are designated by the same reference numerals and duplicate explanation concerning the same constituents is omitted.

In the second embodiment, as shown in FIG. 9, fixing unit 6 of printer 1 includes heater thermistor 51 (serving as a second temperature detector) for detecting the temperature of fixing heater 21, in addition to belt thermistor 27 (serving as a first temperature detector) that is the same as the first embodiment. Such heater thermistor 51 is attached to the vicinity of fixing heater 21 (on the back side of heater holder 22 in this embodiment as shown in FIG. 9) and is configured to detect the temperature of fixing heater 21 (hereinafter referred to as a heater temperature).

In the second embodiment, heater thermistor 51 is attached at the width center position of heater holder 22, a direction of the width of heater holder 22 being orthogonal to a direction in which fixing belt 24 moves.

A print operation execution program is stored in storage unit 37 of printer 1 in advance. The print operation execution program according to the second embodiment includes an application program for executing an abnormality detection process (to be explained later with reference to FIG. 11) or the like, in addition to the normal image forming process execution program which is the same as that of the first embodiment. Steps of the print operation execution program executed by controller 36 refer to functional units of printer 1 in this embodiment.

Also stored in storage unit 37 in advance are a first abnormality determination threshold, a second abnormality determination threshold, the temperature difference history storing time, an abnormality determination time, a time interval used for calculating a change ratio, and a temperature stabilization time period (for example, 30 seconds). The first abnormality determination threshold is a predetermined value used for detecting an abnormality due to a slip of fixing belt 24. The second abnormality determination threshold is a predetermined value used for detecting an abnormality due to poor contact between fixing belt 24 and belt thermistor 27. The temperature difference history storing time is a predetermined interval (for example, 10 ms) at which the history of a temperature difference between the heater temperature and the belt temperature is periodically stored. The abnormality determination time is a predetermined interval (for example, 0.1 second) at which an occurrence of a slip of fixing belt 24 and an occurrence of a poor contact of belt thermistor 27 are periodically judged. The time interval ΔT is a predetermined length of time (for example, one second) used for calculating slope Ks of the temperature difference and change ratio Dks (to be described later) of slope Ks for judging the occurrence of slip and the occurrence of poor contact. The temperature stabilization time period is the same as the first embodiment (for example, 30 seconds).

In addition, as shown in FIG. 10, temperature difference history storage area 53 and temperature difference slope storage area 42 are provided in storage unit 54. Temperature difference history storage area 53 is for the temperature difference information, in which the history of temperature difference Shb between the heater temperature and the belt temperature is stored at a predetermined cycle (at each the temperature difference history storing time). Temperature difference slope storage area 54 is for temperature difference slope information, in which change ratios of the change of the temperature difference between the heater temperature and the belt temperature with time (hereinafter referred to as temperature difference slopes Ks) are stored, and are used for detecting a slip of fixing belt 24 or a poor contact of belt thermistor 27.

By means of software of the print operation execution program in the abnormality determination process, controller 36 of printer 1 in the second embodiment forms therein functional units. Such functional units in the second embodiment are: a first calculator and a second calculator that calculate temperature difference slope Ks in the abnormality detection process based on the belt temperature difference history, a third calculator that calculates change ratio DKs of the temperature difference slope Ks between the current time and one second (ΔT) prior to the current time, and a determiner that compares change ratio DKs of the temperature difference slope with the first and second abnormality determination thresholds and judges the occurrence of a slip of fixing belt 24 and the occurrence of a poor contact of belt thermistor 27.

Temperature difference Shb between the heater temperature and the belt temperature is calculated by the following formula (5).

$$Shb=Sh-Sb(\text{unit:}^\circ\text{ C.}) \quad (5)$$

Sh and Sb represent the heater temperature detected by heater thermistor 51 and the belt temperature detected by belt thermistor 27 at the same time, respectively.

Change amount ΔSs which is the amount of the change of temperature difference Shb with time is calculated by the following formula (6).

$$\Delta Ss=Shb0-Shb1(\text{unit:}^\circ\text{ C.}) \quad (6)$$

Shb0 represents the difference between the heater temperature and the belt temperature detected by heater thermistor 51 and belt thermistor 27 at the current time. Shb1 represents the difference between the heater temperature and the belt temperature at one second (ΔT) prior to the current time, which is stored in temperature difference history storage area 53 of storage unit 37. Note that ΔT is the time interval used for calculating the change ratio and equals one second in this embodiment.

Temperature difference slope Ks, which is a first order differential value of temperature difference Shb between the current time and one second (ΔT) before the current time, is calculated by the following formula (7).

$$Ks=\Delta Ss/\Delta T(\text{unit:}^\circ\text{ C./s}) \quad (7)$$

Temperature difference slope change amount ΔKs, which is an amount of the change of the slope with time, is calculated by the following formula (8).

$$\Delta Ks=Ks0-Ks1(\text{unit:}^\circ\text{ C./s}) \quad (8)$$

Ks0 is the value of temperature difference slope Ks at the current time calculated by the formula (7).

Ks1 is the value of temperature difference slope KS at one second before the current time, which was stored in temperature difference slope storage area 53 of storage unit 37. Note that Ks1 is the value of temperature difference slope Ks at one second before the current time, which is a slope of the change of the temperature difference Shb between two seconds before the current time and one second before the current time.

Change ratio DKs of the temperature difference slope, which is a second order differential value of the change of temperature difference Shb with time, is calculated by the following formula (9).

$$DKs=\Delta Ks/\Delta T(\text{unit:}^\circ\text{ C./s}^2) \quad (9)$$

The relationship between such temperature difference Shb, temperature difference slope Ks, and change ratio DKs of the temperature difference slope will be described with reference to FIG. 12.

Figure 12A:
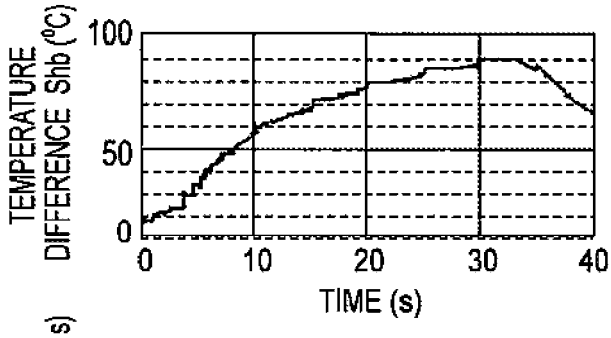
Figure 12B:
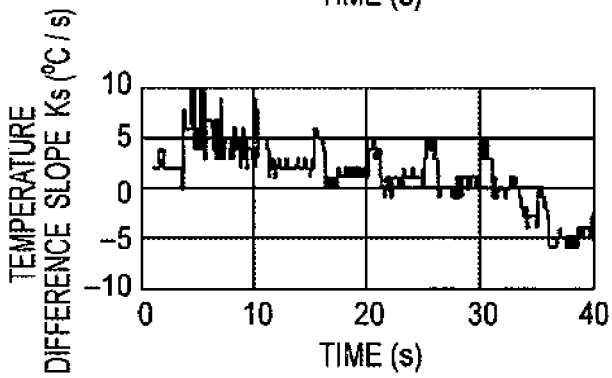
Figure 12C:
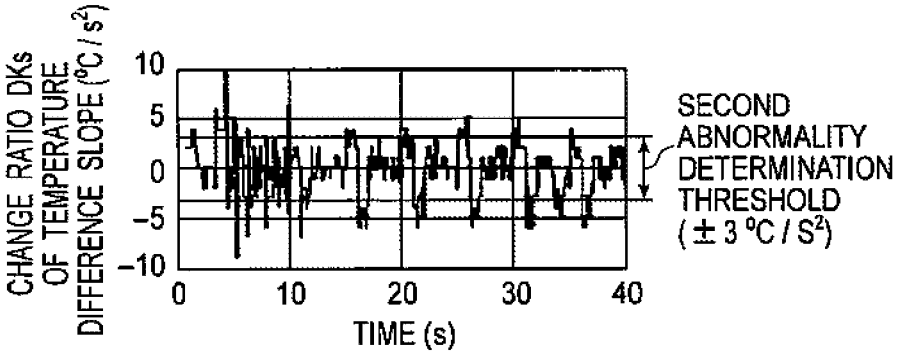

FIGS. 12A, 12B, and 12C relate to the case where poor contacts between fixing belt 24 and belt thermistor 27 intermittently occur:

FIG. 12A shows change of temperature difference Shb between the heater temperature and the belt temperature detected by heater thermistor 51 and belt thermistor 27, respectively. FIG. 12B shows temperature difference slope Ks, which is the slope of change of the temperature difference with time. FIG. 12C is change ratio DKs of the temperature difference slope. FIG. 12 shows change ratio DKs of the temperature difference slope in the case where slip of fixing belt 24 occurs.

As shown in FIG. 12A, even when poor contact of belt thermistor 27 occurs, temperature difference Shb increases as the temperature of fixing heater 21 increase, and temperature difference Shb is maintained at a constant value by the temperature control of power distribution controller 28 after temperature difference Shb reaches the predetermined fixable temperature range, and then temperature difference Shb decreases by heat radiation after fixing heater 21 is turned off.

As shown in FIG. 12B, in the case where poor contact of belt thermistor 27 occurs, slope Ks of temperature difference Shb changes quickly when poor contact occurs, but it is difficult to determine, based on such slope Ks, whether or not poor contact occurs.

However, as shown in FIG. 12C, in the case where poor contact of belt thermistor 27 occurs, change ratio DKs of temperature difference slope Ks (the slope of temperature difference Shb) changes remarkably when poor contact occurs.

Figure 12D:
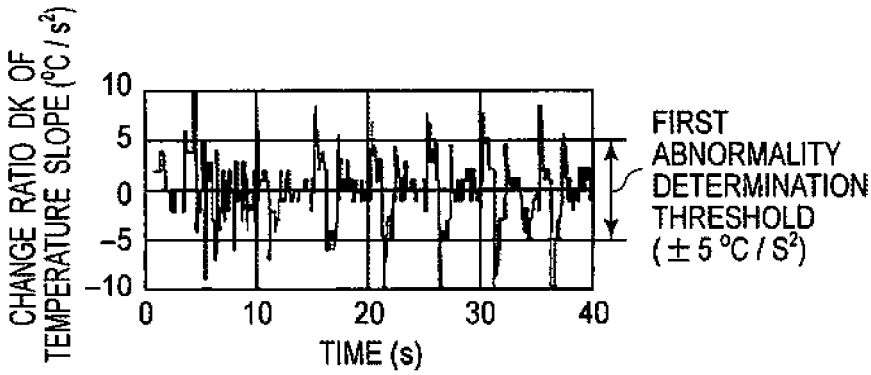

Further, as shown in FIG. 12D, in the case where slip of fixing belt 24 occurs, change ratio DKs of temperature difference slope Ks (the slope of temperature difference Shb) has changes remarkably when poor contact occurs, greater than when slip occurs.

That is, there is a difference in change ratio DKs of the slope of temperature difference Shb between the case where poor contact of belt thermistor 27 occurs and the case where slip of fixing belt 24 occurs. The change in change ratio DKs of the temperature difference slope is greater when slip occurs than when poor contact occurs.

The reason why the difference occurs is the following. When poor contact of belt thermistor 27 occurs and the contact between fixing heater 21 and fixing belt 24 is normal, only the temperature detected by belt thermistor 27 changes abnormally (decreases) due to the poor contact between belt thermistor 27 and fixing belt 24, while the temperature detected by heater thermistor 51 changes normally (increases slowly) because heat of fixing heater 21 is conveyed by fixing belt 24 normally. On the other hand, when slip of fixing belt 24 occurs and the contact between fixing belt 24 and belt thermistor 27 is normal, fixing belt 24 stops moving so that fixing belt 24 does not convey the heat that is supplied from fixing heater 21. Thus, the temperature detected by heater thermistor 51 increases rapidly because the actual temperature of fixing heater 21 increases rapidly, while the temperature detected by belt thermistor 27 decreases because the heat of fixing heater 21 is not supplied to belt thermistor 27. Therefore, temperature difference Shb between heater thermistor 51 and belt thermistor 27 rapidly increases, so that change ratio DKs of the temperature difference slope changes greater than the time when the poor contact of belt thermistor 27 occurs.

As a result, it is found that an abnormality due to a slip of fixing belt 25, which is recoverable by the belt temperature recovery operation, is distinguishable from an abnormality due to a poor contact between fixing belt 24 and belt thermistor 27, which is unrecoverable by the belt temperature recovery operation, by monitoring change ratio DKs of the temperature difference slope and comparing change ratio DKs with thresholds (first and second abnormality determination thresholds).

In this embodiment, the first and second abnormality determination thresholds to be stored in storage unit 37 are determined in advance based on values of change ratio DKs of the temperature difference slope that are derived from experiment. The first abnormality determination threshold for detecting an abnormality due to a slip of fixing belt 24 is set to a range (see FIG. 12D), for example between ±5° C./s$^2$ (equal to or greater than −5° C./s$^2$ and equal to or less than +5° C./s$^2$). When change ratio DKs of the temperature difference slope exceeds the upper limit or the lower limit of the range, it is determined that a slip of fixing belt 24 occurs.

The second abnormality determination threshold for detecting an abnormality due to a poor contact between fixing belt 24 and belt thermistor 27 is set to a range (see FIG. 12C), for example, between ±3° C./s$^2$ (equal or greater than −3° C./s$^2$ and equal or less than +3° C./s$^2$). When change ratio DKs of the temperature difference slope exceeds the upper limit or the lower limit of the range of the second abnormality determination threshold and does not exceed the upper limit and the lower limit of the range of the first abnormality determination threshold, it is determined that a poor contact of belt thermistor 27 occurs.

Next, steps of the abnormality detection process of the second embodiment will be described with reference to the flow chart of FIG. 11.

When the main power supply of printer 1 is turned on, the print operation execution program stored in storage unit 37 in printer 1 is automatically activated, and controller 36 starts executing the image forming process and thus starts the temperature control of fixing unit 6 based on the belt temperature measured based on the output of belt thermistor 27, in the same manner as the first embodiment.

Step SA1: After starting the abnormality detection process, controller 36 reads out the temperature difference history storing time (10 ms in this embodiment) stored in storage unit 37, and monitors an arrival of the temperature difference history storing time with clock unit 38, in order to obtain data of the difference between the heater temperature and the belt temperature, which are basic data used for detecting a slip and a poor contact. When the temperature difference history storing time occurs, controller 36 proceeds to step SA2. When the temperature difference history storing time does not occur, controller 36 proceeds to step SA5.

Step SA2: After determining that the temperature difference history storing time occurs, controller 36 obtains the current time by clock unit 38 and measures the belt temperature of fixing belt 24 (serving as a first temperature or a third temperature in the embodiment) based on the output of belt thermistor 27.

Step SA3: After measuring the belt temperature, controller 36 measures the heater temperature of fixing heater 21 (serving as a second temperature or a fourth temperature in the embodiment) based on the output of heater thermistor 51.

Step SA4: After measuring the heater temperature and the belt temperature, controller 36 (serving as a first or second a calculator) calculates temperature difference Shb (serving as a first temperature difference or a second temperature difference in the embodiment) by means of the formula (5) with the measured heater temperature and the measured belt temperature, in order to obtain temperature difference Shb as basic data used for detecting a slip and a poor contact. Controller 36 stores calculated temperature difference Shb with the obtained current time as temperature difference information to temperature difference history storage area 53 of storage unit 37 in chronological order, and then proceeds to step SA5.

Such temperature difference information stored in temperature difference history storage area 53 of storage unit 37 are used for detecting a slip and a poor contact.

Step SA5: In order to determine an occurrence of a slip or a poor contact in fixing unit 6, controller 36 reads out the abnormality determination time (0.1 second in the embodiment) stored in storage unit 37, monitors an arrival of the abnormality determination time by clock unit 38. When the abnormality determination time occurs, controller 36 proceeds to step SA6.

When the abnormality determination time does not occur, controller 36 proceeds back to step SA1, to continue monitoring an arrival of the temperature difference history storing time in step SA1 and an arrival of the abnormality determination time in step SA5.

Step SA6: After detecting an arrival of the abnormality determination time, controller 36 reads out from storage unit 37 time interval ΔT (one second in the embodiment) and reads out from temperature difference history storage area 53 of storage unit 37, based on this time interval ΔT (one second in the embodiment), temperature difference Shb1 one second before the current time, in order to calculate temperature difference slope Ks. Here, the current time is a time that was recognized in the last step SA2 just before the arrival of the abnormality determination time.

Step SA7: Controller 36 calculates temperature difference slope Ks0 of the current time by means of the formula (7) with temperature difference Shb0 of the current time calculated in step SA4 just before the arrival of the abnormality determination time, temperature difference Shb1, and the time length (ΔT). Controller stores calculated temperature difference slope Ks0 with the current time, as temperature difference slope information, to temperature difference slope storage area 53 of storage unit 37 in time series.

Step SA8: After storing the temperature difference slope information of the current time, controller 36 reads out, from temperature difference slope storage area 53 of storage unit 37, temperature difference slope Ks1, which is temperature difference slope information one second before the current time), in order to calculate change ratio DKs of the slope of temperature difference Shb.

Controller 36 (serving as a third calculator of the embodiment) calculates change ratio DKs of the temperature difference slope by means of formula (9) with temperature difference slope Ks0 of the current time, temperature difference slope Ks1, and the time length (ΔT).

Step SA9: After calculating change ratio DKs of the temperature difference slope, controller 36 determines whether the current operation is the belt temperature recovery operation (see step SAl2). When the current operation is the belt temperature recovery operation, controller 36 proceeds to step SA13 to detect an abnormality in the recovery operation.

When the current operation is not the belt temperature recovery operation, that is, the current operation is the fixing operation of fixing unit 6, controller 36 proceeds step SA10.

Step SA10: After determining that the current operation is the fixing operation of fixing unit 6, controller 36 reads out the second abnormality determination threshold (±3° C./s$^2$ in the embodiment) stored in storage unit 37, in order to determine whether or not any abnormality in the fixing operation occurs. Controller 36 (serving as a determiner in the embodiment) compares calculated change ratio DKs of the temperature difference slope with the read second abnormality determination threshold, and determines that an abnormality occurs in the fixing operation when change ratio DKs exceeds the upper limit or the lower limit of the range of the second abnormality determination threshold, and proceeds to step SA11.

When change ratio DKs does not exceed the upper limit or the lower limit of the range of the second abnormality determination threshold, controller 36 determines that no abnormality occurs in the fixing operation, that is, determines that fixing unit 6 operates normally, and proceeds back to step SA1 to continue monitoring by steps SA1 and SA5.

Step SA11: After determining that an abnormality occurs in the fixing operation, controller 36 reads out the first abnormality determination threshold (±5° C./s$^2$ in the embodiment) stored in storage unit 37, in order to determine the abnormality in the fixing operation is occurrence of a poor contact or occurrence of a slip. Controller (serving as a determiner in the embodiment) compares calculated change ratio DKs with the first abnormality determination threshold, and determines that a slip occurs in the fixing operation when change ratio DKs exceeds the upper limit or the lower limit of the range of the first abnormality determination threshold, and proceeds to step SAl2.

When change ratio DKs does not exceed the upper limit or the lower limit of the range of the first abnormality determination threshold, controller 36 determines that a poor contact occurs in the fixing operation and proceeds to step SA16 via connection A.

Step SAl2: After determining that a slip occurs in the fixing operation, controller 36 stops the image forming process and starts the belt temperature recovery operation of fixing belt 24 in the same manner as step S10 of the first embodiment and proceeds back to step SA1 to continue steps SA1 to SA9 executing the process of obtaining temperature difference history information and the process of calculating change ratio DK of the temperature difference slope.

Step SA13: After determining that the current operation is the belt temperature recovery operation of fixing unit 6, in order to determine whether or not an abnormality in the recovery operation occurs, controller 36 compares change ratio DKs of the temperature difference slope with the second abnormality determination threshold in the same manner as step SA10. When change ratio DKs exceeds the upper limit or the lower limit of the range of the second abnormality determination threshold, controller 36 determines that an abnormality in the recovery operation occurs and proceeds to step SA16.

When change ratio DKs does not exceed the upper limit and the lower limit of the range of the second abnormality determination threshold, controller 36 determines that the recovery operation is normally executing and proceeds to step SA14.

Step SA14: After determining that the recovery operation is normally executing, controller 36 measures the belt temperature based on the output of belt thermistor 27. When the measured belt temperature is equal to or greater than the predetermined fixable temperature, controller 36 proceeds to step SA15.

When the measured belt temperature is less than the predetermined fixable temperature, controller 36 proceeds back to step SA1 to continue steps SA1 to SA9 executing a process of obtaining temperature difference history information and a process of calculating change ratio DK of the temperature difference slope, while continuing the belt temperature recovery operation.

Step SA15: After determining that the belt temperature is equal to or greater than the predetermined fixable temperature, controller 36 executes an idle rotation operation in the same manner as step S13 of the first embodiment in order to stabilize the temperature of upper pressure roller 23. That is, controller 36 continues the idle rotation operation of fixing unit 6 until the temperature stabilization time period elapses, and resumes the parallel-processing image forming process when the elapsed time is equal or greater than the temperature stabilization time period.

Step SA16: After determining (step SA11) that a poor contact occurs in the fixing operation or determining (step SA15) that the abnormality occurs in the recovery operation, controller 36 stops operations of the components of printer 1 including fixing heater 21 and fixing motor 26 of fixing unit 6 and notifies the operator of the occurrence of the abnormality by sounding a warning tone by notification unit 39 and displaying a message prompting the operator to check the cause of the abnormality on the display screen, in order to notify the operator of a possibility of an occurrence of an abnormality in fixing unit 6 that is not caused by another cause such as a noise except for a poor contact of belt thermistor 27 or a slip of fixing belt 24. Controller 36 then ends the image forming process and the abnormality detection process.

Note that when it is determined that poor contact occurs in the fixing operation, controller 36 may display a message saying that the abnormality is caused by the poor contact on the display screen.

In this way, the abnormality detection process according to the second embodiment is executed.

As described above, the second embodiment detects a poor contact of belt thermistor and a slip of fixing belt 24 based on change ratio DK of the temperature difference slope, which is the second order differential value of change of temperature difference Shb with time, by the abnormality detection process, thereby distinguishing between the occurrence of a poor contact in fixing unit 6 and the occurrence of a slip in fixing unit 6. The second embodiment thus prevents damage of fixing unit 6 such as damage of fixing belt 24 caused by an overheat of fixing heater 21 due to the poor contact of belt thermistor 27, thereby improving the safety of printer 1, while preventing toner adhesion on fixing belt 24 caused by an overheat of fixing belt 24 due to the slip of fixing belt 24, thereby stabilizing the print quality.

In addition, the second embodiment detects a poor contact of fixing unit 6 and a slip of fixing belt 24 differently. That is, the second embodiment detects the occurrence of a slip, which is automatically recoverable, with high accuracy. This minimizes the stop time of printer 1.

Further, the second embodiment stops operation of the printer when detecting the abnormality again in the belt temperature recovery operation. The second embodiment thus prevents the overheat of fixing heater 21 or the like caused by unanticipated situations and prevents the damage of fixing unit 6 such as the damage of fixing belt 24, thereby further improving the safety of printer 1.

To summarize, the second embodiment stores in chronological order in the storage unit the difference Shb between the heater temperature and the belt temperature which are detected by the heater thermistor and the belt thermistor, and stores in chronological order in the storage unit temperature difference slope Ks which is the first order differential value of change of temperature difference Shb with time. Calculation of temperature difference slope Ks is based on temperature difference Shb0 at the current time and stored temperature difference Shb1 at time interval ΔT before the current time. Change ratio DKs of the temperature difference slope, which is the second order differential value of the change of the temperature difference with time, is then calculated based on temperature difference slope Ks0 at the current time and stored temperature difference slope Ks1 at the time interval ΔT before the current time. A slip of the fixing belt is indicated when change ratio DKs exceeds the range of the first abnormality determination threshold and a poor contact of the belt thermistor is indicated when change ratio DKs does not exceed the first abnormality determination threshold and does exceed the second abnormality determination threshold. That is, the second embodiment detects and distinguishes between the occurrences of a poor contact and a slip in the fixing unit. The second embodiment thus prevents damage of the fixing unit such as damage of the fixing belt caused by overheat of the fixing belt due to poor contact of the belt thermistor, while preventing toner adhesion on the fixing belt caused by overheat of the fixing belt due to slip of the fixing belt, thereby stabilizing the print quality.

Note that although the abnormality determination time is 0.1 second in the above embodiments, the abnormality determination time is not limited to this but is shorter than a time it takes a point of the fixing belt to go across the length of a contact between the fixing heater and the fixing belt in the direction in which the fixing belt moves (rotates).

Although the above embodiments notify the operator of the occurrence of the abnormality when the abnormality is detected again in the recovery operation, a modification may notify the operator of the occurrence of the abnormality when the abnormality is detected in the fixing operation (for example, step S9 in the first embodiment, step SAl2 in the second embodiment).

Although the fixing heater is provided in sliding contact on the inner circumferential surface of the fixing belt to heat the fixing belt in the above embodiments, the invention is not limited to this configuration; for example, the fixing heater may be provided on the outer circumferential surface of the fixing belt to heat the fixing belt.

Although the fixing heater heats the fixing belt in the above embodiments, the invention does not limit the type of a heater configured to heat the fixing belt; for example, a heater configured to heat the fixing belt may be a halogen heater, an electromagnetic heater, or the like.

Although the image forming apparatus is described as a printer in the above embodiments, the image forming apparatus is not limited to the printer but may be a MFP (Multi-Function Printer), a facsimile machine, a copy machine, or the like.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A heating device comprising:

a driving member configured to be driven by a driver and to rotate;

a driven member being in contact with the driving member and configured to rotate with the rotation of the driving member;

a heater configured to heat a surface of at least one of the driving member and the driven member;

a temperature detector configured to measure the temperature of the heated surface; and a controller operable to control heating of the heater based on the measurement result of the temperature detector, the controller comprising:

a calculator operable to calculate a change ratio of a slope of a temperature change of the heated surface with time, based on a first temperature detected by the temperature detector at a first time point and a second temperature detected by the temperature detector at a second time point, the second time point being a time point when a predetermined time has elapsed from the first time point; and a determiner operable to determine that an abnormality occurs when the change ratio exceeds a threshold.

2. The heating device according to claim 1, wherein the threshold is in a range from $-4°$ C./s$^2$ to $+4°$ C./s$^2$.

3. The heating device according to claim 1, wherein the temperature detector is a thermistor.

4. The heating device according to claim 1, wherein the driving member and the driven member directly or indirectly contacting each other.

5. The heating device according to claim 4, wherein the driving member is a lower pressure roller and the driven member is an upper pressure roller.

6. The heating device according to claim 1, wherein one of the driving member and the driven member is an endless belt.

7. The heating device according to claim 6, wherein the endless belt is the one whose surface temperature is measured by the temperature detector.

8. The heating device according to claim 7, wherein the heater is in slide-contact with the inner circumferential surface of the endless belt.

9. The heating device according to claim 7, wherein the endless belt extends between a roller and the heater such that the roller and the heater are in contact with the inner circumferential surface of the endless belt.

10. The heating device according to claim 1, further comprising:

a notifier configured to notify the operator of the abnormality when the determiner determines that the abnormality occurs.

11. An image forming apparatus comprising the heating device of claim 1.

12. The image forming apparatus according to claim 11, wherein the heating device is a fixing unit configured to fix a developer image to sheet medium.

13. A heating device comprising:

a driving member configured to be driven by a driver and to rotate;

a driven member being in contact with the driving member and configured to rotate with the rotation of the driving member;

a heater configured to heat a surface of at least one of the driving member and the driven member;

a first temperature detector configured to measure the temperature of the heated surface;

a second temperature detector configured to measure the temperature around the heater; and a controller operable to control heating of the heater, the controller comprising:

a first calculator operable to calculate a slope of a first temperature difference of a first time point, the first temperature difference being a difference between a first temperature detected by the first temperature detector at the first time point and a second temperature detected by the second temperature detector at the first time point;

a second calculator operable to calculate a slope of a second temperature difference of a second time point, the second time point being a time point when a predetermined time has elapsed from the first time point, the second temperature difference being a difference between a third temperature detected by the first temperature detector at the second time point and a fourth temperature detected by the second temperature detector at the second time point;

a third calculator operable to calculate a change ratio of temperature difference slope, based on the slope of the first temperature difference and the slope of the second temperature difference; and a determiner operable to determine that an abnormality occurs when the change ratio of the temperature difference exceeds a threshold.

14. The heating device according to claim 13, wherein the threshold includes:

a first threshold used for detecting an abnormality of the driving member; and a second threshold used for detecting an abnormality of the first temperature detector or the second temperature detector.

15. The heating device according to claim 14, wherein the first threshold is in a range from $-5°$ C./s$^2$ to $+5°$ C./s$^2$.

16. The heating device according to claim 14, wherein the second threshold is in a range from $-3°$ C./s$^2$ to $+3°$ C./s$^2$.

17. The heating device according to claim 13, wherein the first temperature detector and the second temperature detector are thermistors.

18. A heating device comprising:

a driving member configured to be driven by a driver and to rotate;

a driven member being in contact with the driving member and configured to rotate with the rotation of the driving member;

a heater configured to heat a surface of at least one of the driving member and the driven member;

a temperature detector configured to measure the temperature of the heated surface; and a controller operable to control heating of the heater based on the measurement result of the temperature detector, the controller comprising:

a determiner operable to determine that an abnormality occurs when a second order differential value of change of the temperature detected by the temperature detector with time exceeds a threshold.

19. The heating device according to claim 18, wherein the temperature detector is a thermistor.

* * * * *